US009737175B2

(12) United States Patent
Wei

(10) Patent No.: US 9,737,175 B2
(45) Date of Patent: Aug. 22, 2017

(54) CONNECTING DEVICE AND SHOWER DOOR ASSEMBLY INCLUDING THE CONNECTING DEVICE

(71) Applicant: Ideal Sanitary Ware Co., Ltd., Foshan (CN)

(72) Inventor: Wuxiang Wei, Foshan (CN)

(73) Assignee: Ideal Sanitary Ware Co., Ltd. (CN)

( * ) Notice: Subject to any disclaimer, the term of this patent is extended or adjusted under 35 U.S.C. 154(b) by 0 days.

(21) Appl. No.: 15/100,590

(22) PCT Filed: Jan. 28, 2015

(86) PCT No.: PCT/CN2015/071768
§ 371 (c)(1),
(2) Date: May 31, 2016

(87) PCT Pub. No.: WO2016/119149
PCT Pub. Date: Aug. 4, 2016

(65) Prior Publication Data
US 2016/0353939 A1 Dec. 8, 2016

(51) Int. Cl.
*A47K 3/34* (2006.01)
*E06B 3/46* (2006.01)
(Continued)

(52) U.S. Cl.
CPC ..... *A47K 3/34* (2013.01); *E06B 3/46* (2013.01); *E06B 3/4636* (2013.01); *E06B 3/964* (2013.01); *E06B 3/968* (2013.01)

(58) Field of Classification Search
CPC A47K 3/34; E06B 3/46; E06B 3/4636; E06B 3/964; E06B 3/968
(Continued)

(56) References Cited

U.S. PATENT DOCUMENTS

2002/0157318 A1* 10/2002 Teubert ..... A47K 3/34 49/360

FOREIGN PATENT DOCUMENTS

CN 203175265 U 9/2013
CN 203175267 U 9/2013
(Continued)

OTHER PUBLICATIONS

International Search Report for Application No. PCT/CN2015/071768 dated Oct. 21, 2015.

*Primary Examiner* — Tuan N Nguyen
(74) *Attorney, Agent, or Firm* — Lerner, David, Littenberg, Krumholz & Mentlik, LLP

(57) ABSTRACT

The present invention relates to the field of sanitary and bathing devices, and particularly to a connecting device for connecting a horizontal track to a vertical side frame of a shower door assembly, and a shower door assembly including the connecting device. The connecting device may comprise: a retaining member capable of being retained to an end of the horizontal track and provided with a lug; a connecting member having a width larger than that of the first opening, and being provided with a second opening; and a locking member provided with a connecting portion, the connecting portion being provided with a projection, wherein the locking member can be in a locked position or in an unlocked position when the projection is away from the connecting member. The shower door assembly comprises: a horizontal track; a vertical side frame provided on an end with a vertical opening.

10 Claims, 8 Drawing Sheets

(51) Int. Cl.
*E06B 3/964* (2006.01)
*E06B 3/968* (2006.01)

(58) Field of Classification Search
USPC ..... 4/610
See application file for complete search history.

(56) References Cited

FOREIGN PATENT DOCUMENTS

| | | | |
|---|---|---|---|
| CN | 203175308 | U | 9/2013 |
| CN | 203394290 | U | 1/2014 |
| CN | 203430290 | U | 2/2014 |
| EP | 0738819 | A2 | 10/1996 |

* cited by examiner

CONNECTING DEVICE AND SHOWER DOOR ASSEMBLY INCLUDING THE CONNECTING DEVICE

CROSS-REFERENCE TO RELATED APPLICATIONS

The present application is a national phase entry under 35 U.S.C §371 of International Application No. PCT/CN2015/071768 filed Jan. 28, 2015, the disclosure of which is hereby incorporated herein by reference.

TECHNICAL FIELD

The present invention relates to the field of sanitary and bathing devices, and particularly to a connecting device of a shower door assembly and a shower door assembly including the connecting device.

BACKGROUND ARTS

Usually a shower door needs a horizontal track and a vertical side frame so as to be openably and closably installed to a shower room, whereby the shower door, the horizontal track and the vertical side frame form a shower door assembly. When installing a shower door, the horizontal track, the vertical side frame and the shower door need to be assembled on site. According to an existing installation method, holes are provided to the vertical side frame; then, the horizontal track, the vertical side frame and the shower door are placed in the installation position of the shower door; the horizontal track and the vertical side frame are mounted together using screws. Due to restrictions of the installation position, such an installation method is time-consuming, and screws often slip or facture, which requires much labor from installation persons.

Technical Problems

The main objective of this invention is to provide a connecting device allowing a horizontal track and a vertical side frame of a shower door assembly to be mounted together conveniently.

Another objective of this invention is to provide a shower door assembly, in which the horizontal track and the vertical side frame are mounted together conveniently.

Technical Solutions

To realize the main objective of this invention, this invention provides a connecting device for connecting a horizontal track to a vertical side frame of a shower door assembly, the vertical side frame being provided on an end with a vertical first opening, the connecting device comprising: a retaining member capable of being retained to an end of the horizontal track and provided with a lug protruding away from the horizontal track; a connecting member capable of being provided within the vertical side frame at a position facing the first opening, having a width larger than that of the first opening, and being provided with a second opening, the lug passing through and extending out of the second opening; and a locking member provided with a connecting portion hinged to a part of the lug that extends out of the second opening through which the lug passes, the connecting portion being provided with a projection, wherein the locking member is in a locked position when the projection abuts against the connecting member, and is in an unlocked position when the projection is away from the connecting member.

According to a specific solution, the retaining member comprises a protrusion provided on a side opposite the lug and capable of extending into a cavity of the horizontal track.

According to another specific solution, the connecting member comprises a position-limiting structure being capable of cooperating with a position-limiting structure of the vertical side frame.

According to yet another specific solution, the retaining member comprises a bent wall at an outer periphery thereof, and an end of the horizontal track is capable of being inserted into the bent wall.

Preferably, the vertical side frame comprises a groove, the first opening is provided on a bottom wall of the groove, and the connecting member is provided with a reinforcing plate that is capable of being provided outside a side wall of the groove.

Specifically, a width of a base part of the lug protruding from the retaining member is greater than that of the protruding part, and the base part is capable of abutting against an inner wall of the groove.

To realize another objective of this invention, this invention provides a shower door assembly, comprising: a horizontal track; a vertical side frame provided on an end with a vertical first opening; and a connecting device for connecting the horizontal track to the vertical side frame. The connecting device comprises: a retaining member capable of being retained to an end of the horizontal track and provided with a lug protruding away from the horizontal track; a connecting member capable of being provided within the vertical side frame at a position facing the first opening, having a width larger than that of the first opening, and being provided with a second opening, the lug passing through and extending out of the second opening; and a locking member provided with a connecting portion hinged to a part of the lug that extends out of the second opening through which the lug passes, the connecting portion being provided with a projection, wherein the locking member is in a locked position when the projection abuts against the connecting member, and is in an unlocked position when the projection is away from the connecting member.

Advantageous Effects

When using the connecting device of this invention, first, the retaining member and the horizontal track may be fixed, and the locking member is provided in the unlocked position; then, the horizontal track of the shower door assembly is moved to the installation position, the connecting member is mounted to the vertical side frame from the end with the connecting member facing the opening, and the locking member is rotated from the unlocked position to the locked position, whereby relative fixing between the horizontal track and the vertical side frame can be realized. Thus, the operations do not require other auxiliary tools, are simple, convenient and consume less time.

Accordingly, when assembling the shower door assembly of this invention, first, the retaining member and the horizontal track may be fixed, and the locking member is provided in the unlocked position; then, the horizontal track of the shower door assembly is moved to the installation position, the connecting member is mounted to the vertical side frame from the end with the connecting member facing the opening, and the locking member is rotated from the unlocked position to the locked position, whereby relative fixing between the horizontal track and the vertical side frame can be realized. Thus, the assembling operations of the shower door assembly do not require other auxiliary tools, are simple, convenient and consume less time.

Further, fixing of the horizontal track and the retaining member can be facilitated by the protrusion and the chamber cooperating with each other, and the retaining member cannot move in a direction parallel with an end face of the horizontal track easily. Cooperating between position-limiting structures of the connecting member and the vertical side frame can maintain the relative positions of the connecting member and the vertical side frame in the vertical direction.

In addition, by inserting the horizontal track into the bent wall, movement between the horizontal track and the retaining member in a direction parallel with the end surface of the horizontal track can be restricted; the bent wall of the retaining member can protect the horizontal track and hide a connection slit between the horizontal track and the retaining member, making the appearance beautiful.

Furthermore, the reinforcing plate can enhance the strength of the connecting member and prevent damages to the same. The base part has a larger width, so that the strength of the lug can be enhanced, preventing damages to the lug.

This invention will be further explained in combination with the figures and the embodiments.

PREFERRED EMBODIMENTS

Figure 1:
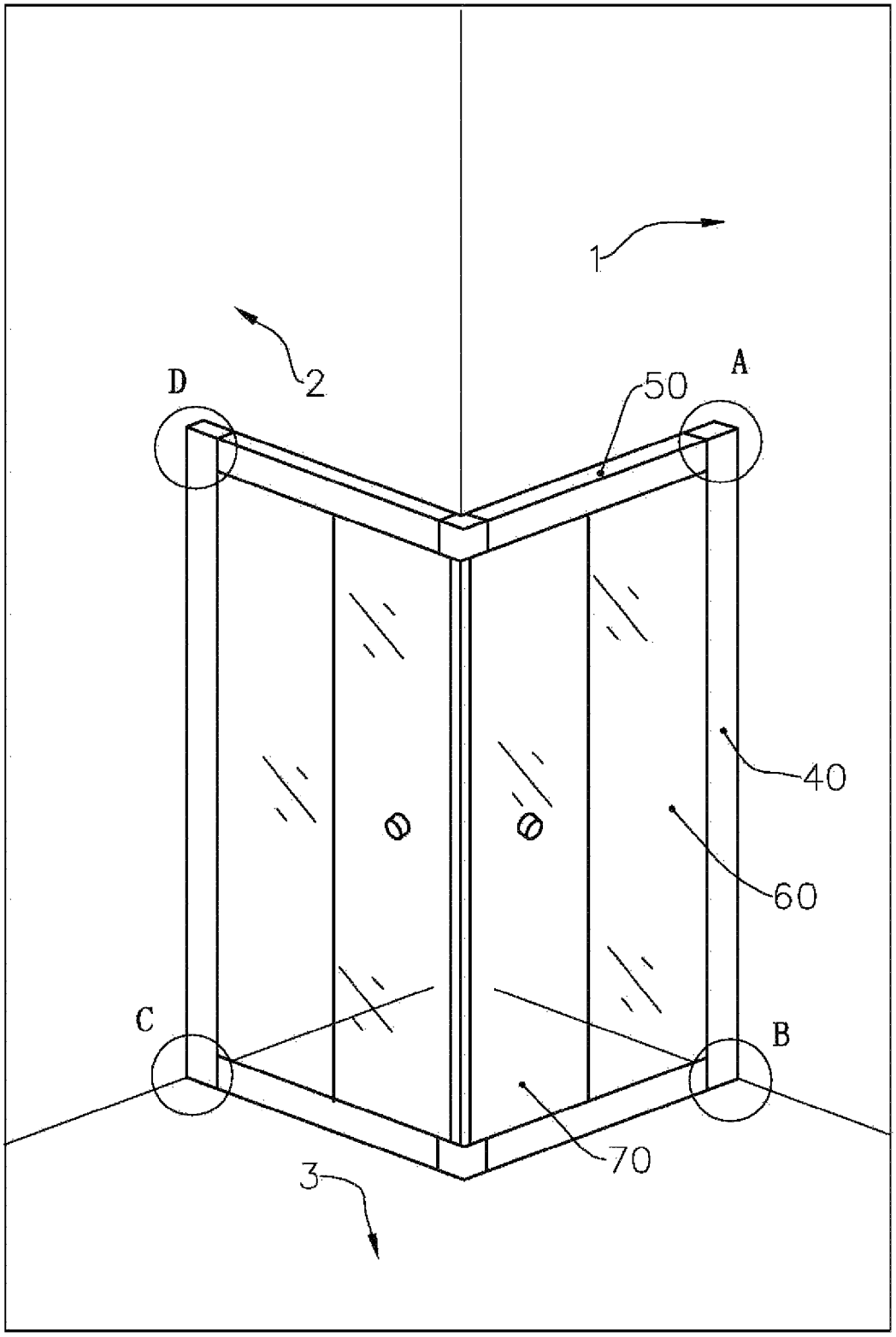
FIG. 1 is a schematic view of an embodiment of a shower door assembly of this invention at the installation position.

As shown in FIG. 1, a shower door assembly is installed between walls 1, 2 and the ground 3 by a vertical side frame 40 and a horizontal track 50. A glass panel 60 is fixed by the vertical side frame 40 and the horizontal track 50. A shower door 70 can slide along the horizontal track 50 so as to be opened and closed. Connecting devices of an embodiment of this invention can be mounted at the positions A, B, C and D shown in FIG. 1.

Figure 2:
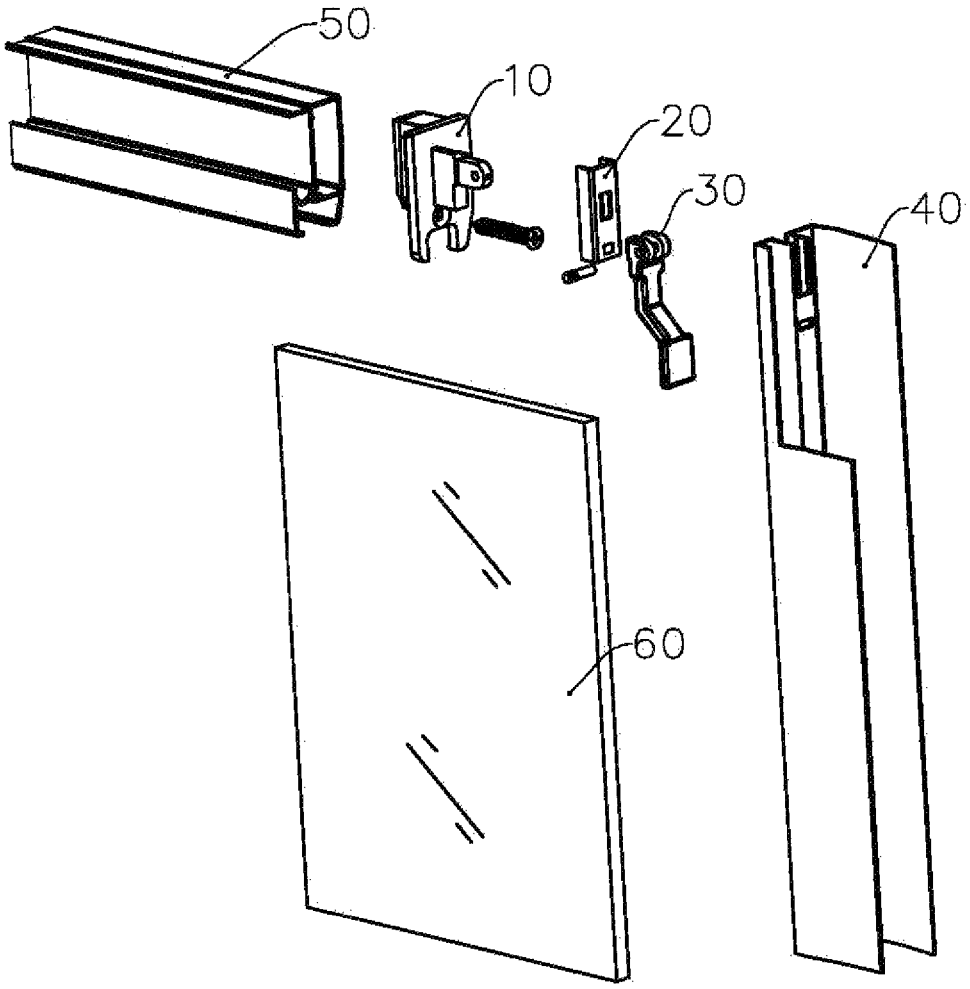
FIG. 2 is a partial structural exploded view of an embodiment of a shower door assembly of this invention.

The shower door assembly of this invention shown in FIG. 2 only shows the structures related to the concept of the invention, and other structures may be the same as or similar to the prior arts. As shown in FIG. 2, the shower door assembly comprises the horizontal track 50, the vertical side frame 40 and the fixed glass panel 60. The fixed glass panel 60 is mounted to the horizontal track 50 and the vertical side frame 40. A connecting device for connecting the horizontal track 50 and the vertical side frame 40 comprises a retaining member 10, a connecting member 20 and a locking member 30, wherein the retaining member may be mounted to the horizontal track 50 by a screw, the retaining member 10 and the locking member 30 may be hinged together by a pin.

Figure 3:
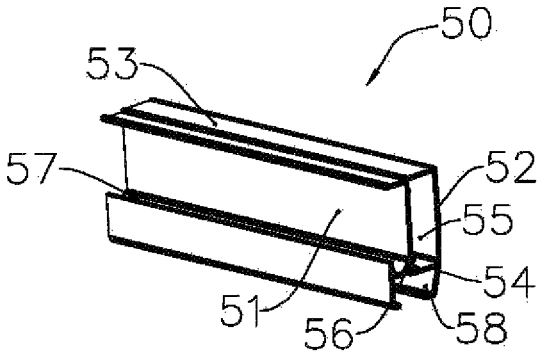
FIG. 3 is a schematic view of a horizontal track of an embodiment of a shower door assembly of this invention.

As shown in FIG. 3, a rectangular chamber 55 is defined by a front wall 51, a rear wall 52, an upper wall 53 and a lower wall 54 of the horizontal track 50. A screw hole 56 is provided to be close to the lower wall 54. The front wall 51 is provided with a slide channel 57 along which the shower door 70 may slide. The lower wall 54 is provided with an installation channel 58 for installing the fixed glass panel 60, a door seal and the like.

Figure 4:
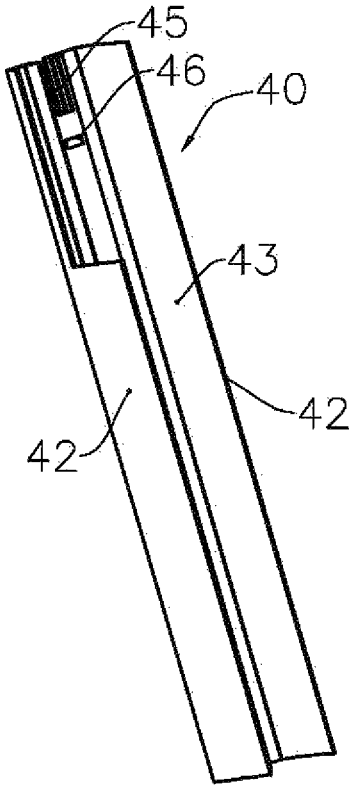
FIG. 4 is a schematic view of a vertical side frame of an embodiment of a shower door assembly of this invention.
Figure 5:
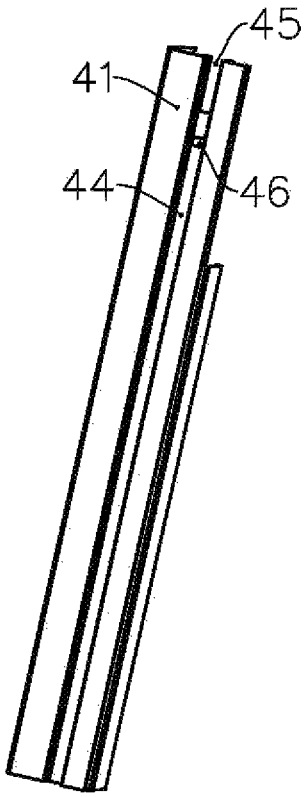
FIG. 5 is a schematic view of a vertical side frame of an embodiment of a shower door assembly of this invention from another view angle.

For clear illustration, a portion of a side of the vertical side frame 40 shown in FIGS. 4 and 5 is cut off. As shown in FIGS. 4 and 5, the vertical side frame 40 comprises a bottom wall 41 and two side walls 42 extending in a direction perpendicular with the bottom wall 41, so that an inner space 43 is defined by the bottom wall 41 and the two side walls. An intermediate portion of the bottom wall 41 is concaved toward the inner space 43 to form an installation channel 44 for installing the fixed glass panel 60, a door seal and the like. An end of the bottom wall 41 is provided with an opening 45 which is also disposed on a bottom wall of the installation channel 44. A locking hole 46 acting as a position-limiting structure is provided below the opening 45.

Figure 6:
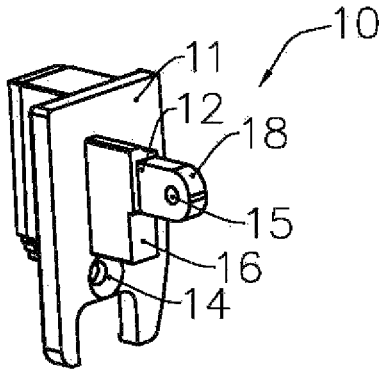
FIG. 6 is a schematic view of a retaining member of an embodiment of a connecting device of this invention.
Figure 7:
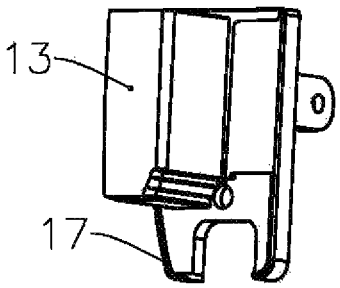
FIG. 7 is a schematic view of a retaining member of an embodiment of a connecting device of this invention from another view angle.

As shown in FIGS. 6 and 7, the retaining member 10 comprises a retaining plate 11 provided with a lug 12 extending in a direction away from the horizontal track, a protrusion 13 with a cross section area slightly smaller than that of the chamber 55 is provided at an opposite side, so that the protrusion 13 can extend into the chamber 55 of the horizontal track 50, thereby helping to fix the retaining member 10. The lug 12 comprises a base part 16 and an extending part 18 which is provided with a hole 15. The retaining plate 11 is provided with a hole 14, so that the retaining member 10 can be fixed on an end face of the horizontal track 50 by a screw. A periphery of the retaining plate 11 is provided with a bent wall 17 extending towards the horizontal track 50, so that the end of the horizontal track 50 can be inserted into the bent wall 17, thereby protecting the end of the horizontal track and hiding a connection slit between the horizontal track and the retaining member.

Figure 8:
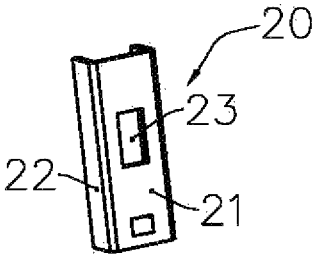
FIG. 8 is a schematic view of a connecting member of an embodiment of a connecting device of this invention.
Figure 9:
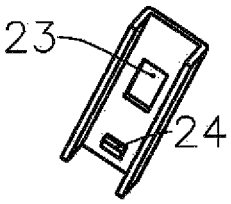
FIG. 9 is a schematic view of a connecting member of an embodiment of a connecting device of this invention from another view angle.

As shown in FIGS. 8 and 9, the connecting member 20 includes a main body 21 and reinforcing plates 22 extending from the two sides of the main body 21 to reinforce the strength of the connecting member 20. The main body 21 is provided with an opening 23 from which the extending part 18 of the lug 12 may extend out. A hook 24 as a position-limiting structure is provided below the opening 23, and may extend into the locking hole 46 of the vertical side frame 40 to restrict movement of the connecting member 20 in a direction perpendicular with the horizontal track.

Figure 10:
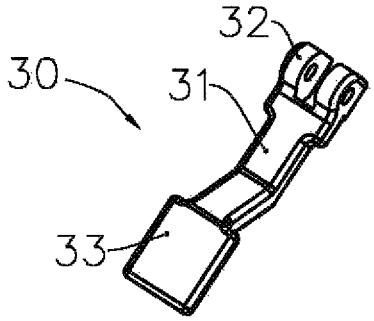
FIG. 10 is a schematic view of a locking member of an embodiment of a connecting device of this invention.
Figure 11:
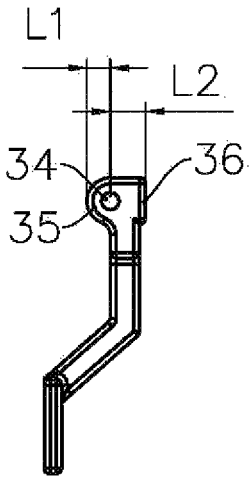
FIG. 11 is a schematic side view of a locking member of an embodiment of a connecting device of this invention.

As shown in FIGS. 10 and 11, the locking member 30 includes a connecting portion 32 to be hinged with the lug 12, a hand-held part 33 for applying with a force to rotate the locking member 30, and an intermediate part 31 between the connecting portion 32 and the hand-held part 33. The connecting portion 32 comprises an opening, and a width of the opening is basically identical with that of the extending part 18, so that the extending part 18 is clamped within the connecting portion 32. A hole 34 is provided to the connecting portion 32 at a position corresponding to the hole 15. Hinging between the connecting portion 32 and the lug 12 can be realized by a pin passing through the holes 34 and 15. That is, the locking member 30 can rotate around the central axes of the holes 34 and 15. The locking member 30 includes an arc part 35 and a projection 36. A distance L1 from the arc part 35 to the central axis of the hole 34 is smaller than a distance L2 from the projection 36 to the central axis of the hole 34. When the arc part 35 faces the connecting member 20, the locking member 30 is in the unlocked position; and when the projection 36 faces the connecting member 20, the locking member 30 is in the locked position.

Figure 12:
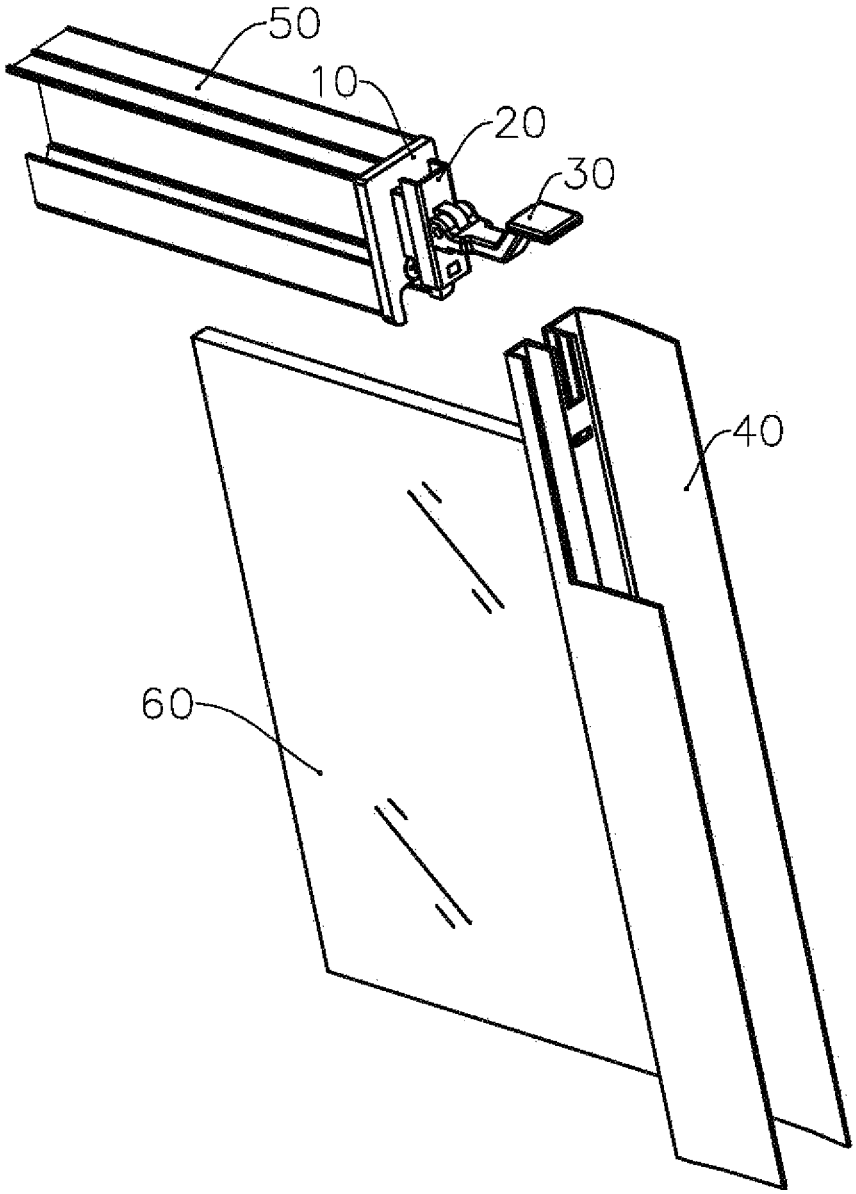
FIG. 12 is a partial schematic view of an embodiment of a shower door assembly of this invention during installation.
Figure 13:
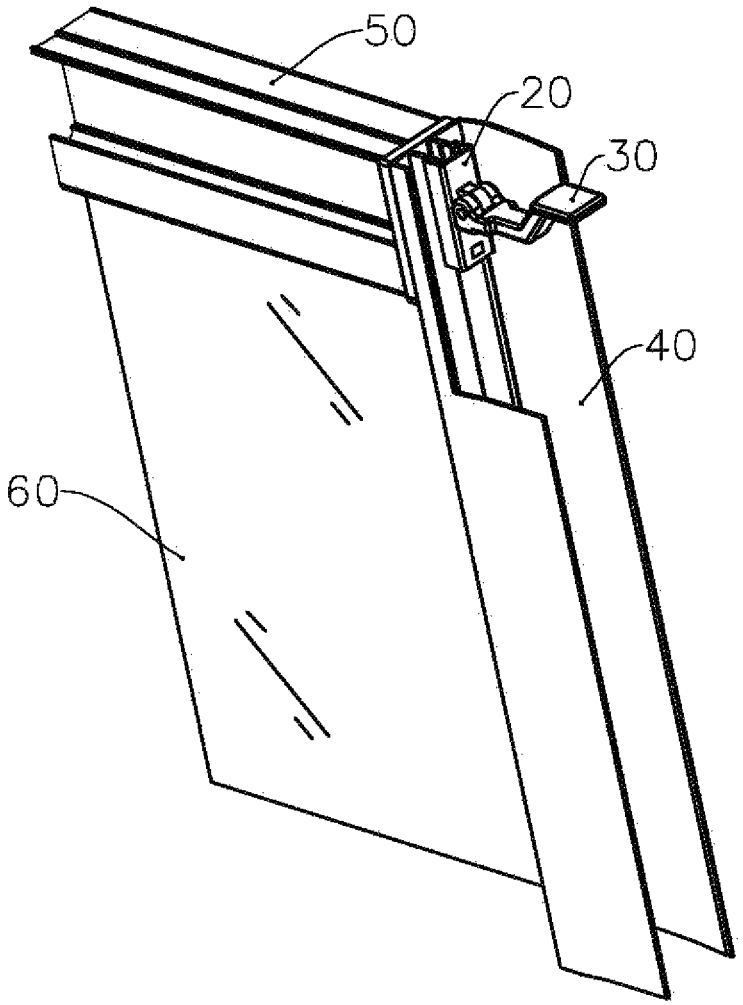
FIG. 13 is a partial schematic view of an embodiment of a shower door assembly of this invention during installation.
Figure 14:
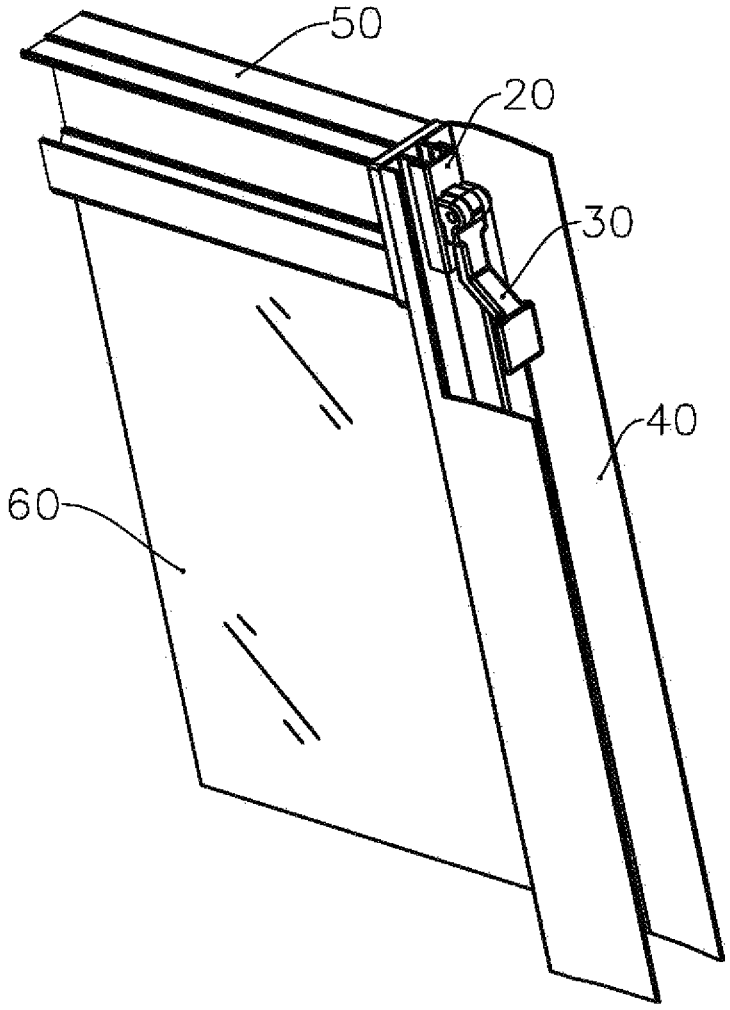
FIG. 14 is a partial schematic view of an embodiment of a shower door assembly of this invention after installation.

A process of connecting the horizontal track 50 and the vertical side frame 40 using the connecting device of this invention is shown in FIGS. 12-14. The retaining member 10 may be fixed to an end of the horizontal track 50 by a screw in advance. The end of the horizontal track 50 extends into the bent wall 17, so that the extending part 18 of the lug 12 passes through the opening 23 of the connecting member 20 to form a protruding part protruding from the opening 23, and is hinged with the connecting portion 32 of the locking member 30. When the arc part 35 of the connecting portion 32 of the locking member 30 faces the connecting member 20, the locking member 30 is in the unlocked position and may be generally parallel with the horizontal track 50. When assembling on site, the fixed glass panel 60 may be installed in the installation channel 44 of the vertical side frame 40. Then, the horizontal track 50 is moved towards the vertical side frame 40, so that the base part 16 of the lug 12 of the retaining member 10 enters into the installation channel 44 from an end of the vertical side frame 40. At the same time, the connecting member 20 and the extending part 18 of the lug 12 enter into the inner space 43 of the vertical side frame 40 along the opening 45, and the reinforcing plates 22 of the connecting member 20 are positioned at outer sides of the two side walls of the installation channel 44. Then, the locking member 30 is rotated to move towards the locked position. The projection 36 moves accordingly. When the projection 36 faces and presses against the connecting member 20, the connecting member 20 is pushed to abut against the bottom wall of the installation channel 44. At the same time, the horizontal track 50 is pulled inversely to approach the vertical side frame 40, and the hook 24 of the connecting member 20 enters into the locking hole 46 of the vertical side frame 40. Thus, the locking member 30 is in the locked position, is basically perpendicular with the horizontal track 50 and is positioned within the inner space 43, thereby completing the connection between the horizontal track 50 and the vertical side frame 40. Therefore, the connection process is simple and convenient and does not need other auxiliary tools.

When detaching the horizontal track 50 from the vertical side frame 40, the locking member 30 is reversely rotated such that the arc part 35 of the locking member 30 faces the connecting member 20; the connecting member 20 may move until the hook 24 releases from the locking hole 46; then, the connecting device may move along the opening 45 and may be detached from the end of the vertical side frame 40. In such a way, the horizontal track can be detached from the vertical side frame easily and quickly without any auxiliary tools.

In other embodiments, connection between the retaining member and the horizontal track may realized by buckling or the like. The position-limiting structures of the connecting member and the vertical side frame may adopt other manners. The hinging manner between the locking member and the lug may be replaced by other known manners. For example, the lug may have a hooked shape and may be hooked to a connecting rod inside the opening of the connecting portion.

The above is preferred embodiments of this embodiment. The design concept of this invention is limited thereto, and non-substantive modifications to this invention using this concept shall also fall into the protection scope of this invention.

INDUSTRIAL APPLICABILITY

The shower door assembly of this invention is installed in a toilet, and acts as an important part of a shower room, which may be an integral shower room having a chassis or a shower room enclosed by the shower door assembly and walls with the shower door assembly installed between two adjacent walls with an included angle therebetween. The shower door assembly of this invention may only include an upper track or may include both upper and lower tracks.

The shower door assembly of this invention is applicable for on-site assembling in customers' toilets. By applying the product of this invention, installation operations of the shower door assembly are simple. Relative fixing of the horizontal track and the vertical side frame can be realized by moving the locking member to the unlocked position to the locked position, which is simple and does not require other auxiliary tools. Therefore, assembling of the shower door assembly requires less time, thereby realizing quick and easy installation of the shower door assembly and reducing the manufacturing and assembling costs of the shower door assembly.

The invention claimed is:

1. A connecting device for connecting a horizontal track to a vertical side frame of a shower door assembly, the vertical side frame being provided on an end with a vertical first opening, the connecting device being characterized by comprising:

a retaining member capable of being retained to an end of the horizontal track and provided with a lug protruding away from the horizontal track;

a connecting member capable of being provided within the vertical side frame and at a position facing the first opening, having a width larger than that of the first opening, and being provided with a second opening, the lug passing through and extending out of the second opening; and a locking member provided with a connecting portion hinged to a part of the lug that extends out of the second opening through which the lug passes, the connecting portion being provided with a projection, wherein the locking member is in a locked position when the projection abuts against the connecting member, and is in an unlocked position when the projection is away from the connecting member.

2. The connecting device according to claim 1, wherein the retaining member comprises a protrusion provided on a side opposite the lug and capable of extending into a cavity of the horizontal track.

3. The connecting device according to claim 1, wherein the connecting member comprises a position-limiting structure capable of cooperating with a position-limiting structure of the vertical side frame.

4. The connecting device according to claim 1, wherein the retaining member comprises a bent wall at an outer periphery thereof, and an end of the horizontal track is capable of being inserted into the bent wall.

5. The connecting device according to claim 1, wherein: the vertical side frame comprises a groove, the first opening is provided on a bottom wall of the groove, and the connecting member is provided with a reinforcing plate that is capable of being disposed outside a side wall of the groove.

6. The connecting device according to claim 5, wherein a width of a base part of the lug protruding from the retaining member is greater than that of the protruding part, and the base part is capable of abutting against an inner wall of the groove.

7. A shower door assembly, comprising:

a horizontal track;

a vertical side frame provided on an end with a vertical first opening; and a connecting device connecting the horizontal track to the vertical side frame, characterized in that, the connecting device comprises:

a retaining member capable of being retained to an end of the horizontal track, and provided with a lug protruding away from the horizontal track;

a connecting member capable of being provided within the vertical side frame and at a position facing the first opening, having a width larger than that of the first opening, and being provided with a second opening, the lug passing through the second opening and extending out of the hole; and a locking member provided with a connecting portion hinged to a part of the lug that extends out of the second opening through which the lug passes, the connecting portion being provided with a projection, wherein the locking member is in a locked position when the projection abuts against the connecting member, and is in an unlocked position when the projection is away from the connecting member.

8. The shower door assembly according to claim 7, wherein the retaining member comprises a protrusion provided on a side opposite the lug and capable of extending into a passage of the horizontal track; and the retaining member comprises a bent wall at an outer periphery thereof, and an end of the horizontal track is capable of being inserted into the bent wall.

9. The shower door assembly according to claim 7, wherein the connecting member comprises a position-limiting structure capable of cooperating with a position-limiting structure of the vertical side frame.

10. The shower door assembly according to claim 7, wherein the vertical side frame comprises a groove, the first opening is provided on a bottom wall of the groove, and the connecting member is provided with a reinforcing plate that is capable of being disposed outside a side wall of the groove.

* * * * *